US006577055B1

(12) United States Patent
Sugawara et al.

(10) Patent No.: US 6,577,055 B1
(45) Date of Patent: Jun. 10, 2003

(54) GLASS FUNNEL HAVING ARCH-LIKE RIDGE PORTIONS AND CATHODE RAY TUBE USING SAME

(75) Inventors: Tsunehiko Sugawara, Chiba (JP); Toshihide Murakami, Chiba (JP); Kentaro Tatsukoshi, Chiba (JP)

(73) Assignee: Asahi Glass Company, Limited, Tokyo (JP)

( * ) Notice: Subject to any disclaimer, the term of this patent is extended or adjusted under 35 U.S.C. 154(b) by 221 days.

(21) Appl. No.: 09/592,555

(22) Filed: Jun. 12, 2000

(30) Foreign Application Priority Data

Jun. 29, 1999 (JP) ..... 11-184308

(51) Int. Cl.[7] ..... H01J 31/00; H01J 61/30

(52) U.S. Cl. ..... 313/477 R; 220/2.1 A; 220/2.1 R

(58) Field of Search ..... 313/477 R, 2.1; 220/2.1 A, 2.1 R

(56) References Cited

U.S. PATENT DOCUMENTS 4,069,354 A * 1/1978 Pekosh ..... 118/318
4,712,038 A * 12/1987 Takenaka et al. ..... 220/2.1 A
5,510,671 A * 4/1996 Nakamura et al. ..... 220/2.1 A

FOREIGN PATENT DOCUMENTS

| | | |
|---|---|---|
| EP | 0369770 | 5/1990 |
| FR | 867.824 | 11/1941 |
| GB | 656682 | 8/1951 |
| GB | 1 487 282 | 9/1977 |
| JP | 63-102145 | 5/1988 |
| JP | 363102145 A * | 5/1988 |

* cited by examiner

*Primary Examiner*—Nimeshkumar D. Patel
*Assistant Examiner*—Matt Hodges
(74) *Attorney, Agent, or Firm*—Oblon, Spivak, McClelland, Maier & Neustadt, PC

(57) ABSTRACT

A glass funnel for a cathode ray tube capable of increasing the rigidity of a body portion having a rectangular-shaped open end portion and reducing the weight of the glass funnel wherein on at least a long side of the body portion, arched face portions are formed so as to be substantially perpendicular to an open end face of the body portion and an arch-like ridge portion in each of the arched face portions is extended to portions in the vicinity of the open end portion, whereby stresses generated in the body portion can be transmitted to the corner portions of high rigidity of the open end portion along the ridge portions.

8 Claims, 4 Drawing Sheets

GLASS FUNNEL HAVING ARCH-LIKE RIDGE PORTIONS AND CATHODE RAY TUBE USING SAME

The present invention relates to a glass funnel for a cathode ray tube used mainly for receiving television broadcast signals and for industrial equipments, and a cathode ray tube using such glass funnel.

BACKGROUND OF THE INVENTION

A cathode ray tube comprises a glass bulb as a vacuumed envelop which includes basically a glass panel 1 for displaying images and a glass funnel 2 having a neck portion 5 for housing an electron gun 6 as shown in FIG. 7. The major components of the glass funnel 2 are a yoke portion 4 for mounting a deflection coil 7 and a body portion 3 which is contiguous to the yoke portion and extends toward an open end portion for sealing the glass panel 1. Reference numeral 10 designates a sealing portion for sealing the glass panel 1 to the glass funnel 2 with a solder glass or the like and a character A indicates a tube axis connecting the central axis of the neck portion 5 with the center of the glass panel 1.

The inside of the cathode ray tube is maintained under a high vacuum condition because an image is displayed by irradiating electron beams in the glass bulb. Further, it has an asymmetric structure unlike a spherical shape and suffers a differential pressure of 1 atmospheric pressure between the inside and the outside of the glass bulb. Accordingly, there is always a high deformation energy, and therefore, the glass bulb is in an unstable state in structure. When a crack is generated in the glass bulb for the cathode ray tube in such a state, the crack will develop because the high deformation energy tends to be released to thereby cause destruction. Further, in such a condition that a high tensile stress is applied to the an outer surface portion of the glass bulb, a delayed destruction may be resulted due to the function of moisture in the atmosphere, whereby the glass bulb loses reliability.

On the other hand, various kinds of image displaying devices other than the cathode ray tubes have been proposed in recent years. In comparison of the cathode ray tube with the proposed image displaying devices, it has been said that the disadvantages of the cathode ray tube reside in a large depth and a large weight. Therefore, the problems to be urgently solved are to shorten the depth and reduce the weight.

However, in an attempt of shortening the depth of the conventional cathode ray tube, a degree of asymmetry in the structure of the cathode ray tube is increased whereby there arises the problem that a more amount of deformation energy is accumulated in the glass bulb. Further, in an attempt of reducing the weight, an increase of the deformation energy is caused due to reduction in the rigidity of the glass bulb. Since the increase of the deformation energy increases stresses, reduction in safety by the destruction and reduction in reliability by the delayed destruction are accelerated. An attempt to increase the wall thickness of the glass bulb in order to prevent the increase of the stress inevitably results an increase of weight.

BRIEF SUMMARY OF THE INVENTION

It is an object of the present invention to provide a glass funnel for a cathode ray tube which is safe and highly reliable and which can realize the reduction of the dimension in depth and the weight of the glass funnel without increasing stresses in the glass funnel, and to provide a cathode ray tube using the glass funnel.

The inventors of the present invention have made various studies to reduce stresses produced in the glass funnel and have found that when arch-like ridge portions are provided in a body portion of the glass funnel so that both ends of each of the arch-like ridge portions are terminated at or near corner portions of an open end portion of the body portion, a deformation in the body portion can be suppressed, namely, the production of stresses can be suppressed.

In accordance with the present invention, there is provided a glass funnel for a cathode ray tube comprising a funnel-like body portion having a rectangular-shaped open end portion at its one end, a yoke portion formed contiguous to the other end of the body portion and a neck portion connected hermetically to the free end of the yoke portion, wherein the body portion has, on at least its long side, substantially flat arched face portions each of which is substantially perpendicular to an open end face in the rectangular-shaped open end portion and has an arch-like ridge portion whose both ends are extended to portions in the vicinity of corner portions of the open end portion, and the body portion is formed with the arched face portions and a dome-like portion.

The present invention is to suppress a deformation in the body portion by providing arch-like ridge portions in the body portion of the glass funnel to thereby prevent an increase of stresses generated in that portion.

First, description on the relation of the shape of a glass funnel to a stress generated in that portion will be made. In an ordinary cathode ray tube, a neck portion is positioned at the tail in a glass funnel sealed with a glass panel, and a yoke portion is positioned in front of the neck portion wherein a body portion assumes a funnel-like shape so that the body portion gently connects the yoke portion and the glass panel. An open end portion is formed at a front end to provide a sealing portion to the glass panel. The open end portion is in a rectangular shape or a nearly rectangular shape.

It is ideal to bring the shape of the cathode ray tube close to a spherical shape to thereby prevent an increase of the stresses. However, the cathode ray tube has essentially an asymmetric shape because the function of a front face portion to display an image is different from the function of a rear portion for scanning by irradiating electron beams.

Generally, the body portion having a gently curved line in the glass funnel rather has a low rigidity due to the asymmetric shape. In the cathode ray tube having an asymmetric shape, the glass funnel tends to deform by a compressive force in vacuum in a direction of pushing it toward the glass panel, and a tensile stress is generated in the body portion and the sealing portion for sealing the glass panel, which is the weakest in strength. In particular, since a central portion in a long side of the body portion has a relatively low rigidity, a large stress is generated in an open end portion of the body portion. The generated stress reduces safety and reliability on the glass funnel.

In order to reduce such stresses, it is preferred to control a deformation of the body portion on which a force acts so as to push it in the direction of the glass panel. On the other hand, the rigidity of the corner portions at the open end portion of the glass funnel is higher than that of the side portions and a stress generated under a vacuum condition is lower. In order to suppress a possible deformation of the body portion, it is effective to design the body portion of low rigidity to have a shape difficult to deform, or it is effective to support the body portion having a low rigidity with the corner portions having a high rigidity and low stress in vacuum. With such measures, the occurrence of deformation in the body portion can previously prevented or reduced. Further, the concentration of stresses in a portion near the open end portion in the middle of the long side, which is low in rigidity and is apt to deform, can be prevented and therefore, the deformation of this portion can be suppressed.

The present invention is characterized by forming arch-like ridge portions in the body portion so that both ends (end points) of each ridge portion are extended to corner portions or portions near the corner portions in the open end portion of the body portion, whereby a force which may cause the deformation of the body portion is transmitted efficiently to the corner portions in the open end portion. As generally known, an arch-like structure can convert a force applied to an arch into a compressive force acting on a direction along the arch so that the applicable force is transmitted to both ends of the arch. Accordingly, when arch-like ridge portions are provided in the body portion of the glass funnel, an arch-like structure presents a desirable effect of increasing the strength of the body portion.

In the present invention, the arch-like ridge portions are provided by forming the faces which are at sides of the open end portion of the body portion and which extend substantially perpendicular to the open end face, i.e., extend along the direction of the tube axis of the glass funnel. Namely, each of the ridge portions provides the boundary between the funnel-like body portion and a face formed at a side of the open end portion of the body portion. Accordingly, each of the ridge portions presents an arch-like shape wherein both ends of each of the ridge portions reach portions in the vicinity of the corner portions of the open end portion. As a result, at each side of the body portion, an arched face portion having an upper portion which is fringed with the arch-like ridge portion is formed.

It is effective for the arched face portion to have a substantially flat surface structure wherein the major portion of the arched face portion is flat or slightly curved. The body portion of the glass funnel comprises arched face portions in parts and a dome-like curved face (a dome-like portion) in the remainder although the body portion is not gently curved but is in a funnel-like form as a whole. The provision of the arched face portions, i.e., the provision of the surfaces substantially perpendicular to the open end face in the body portion suppresses a deformation in the body portion in the direction of pushing toward the open end portion of the body portion. Accordingly, the arched face portions should be formed in portions on the long side of the open end portion because the portions on the long side are in particular low in strength.

However, a high stress may be produced not only in a long side of the open end portion but also in a short side thereof depending on the shape and the aspect ratio of the glass panel. In such case, arched face portions, i.e., arch-like ridge portions should be formed at the short side in the same manner as described above. In consideration of reducing a burden on the long side, it is preferable to form the arch-like ridge portions on the short side whereby the rigidity of the body portion can be increase as a whole and effects can be promoted.

DETAILED DESCRIPTION OF THE INVENTION

Preferred embodiments of the present invention will be described in detail with reference to the drawings.

FIGS. 1 to 4 show the glass funnel according to an embodiment of the present invention wherein arch-like ridge portions are formed at long and short sides.

Figure 2:
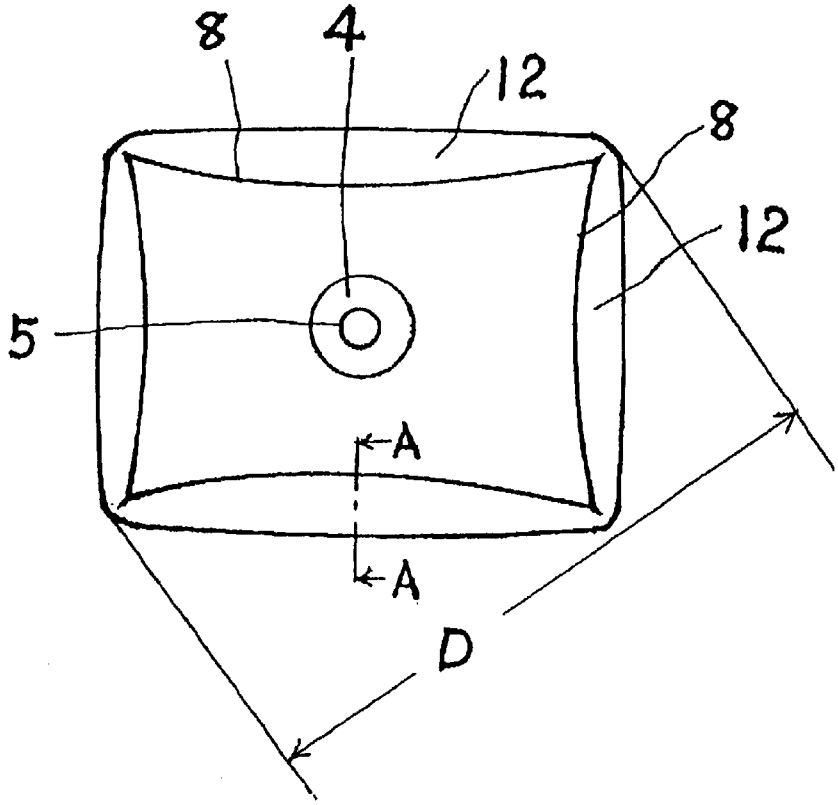
FIG. 2 is a plan view of the glass funnel shown in FIG. 1.
Figure 3:
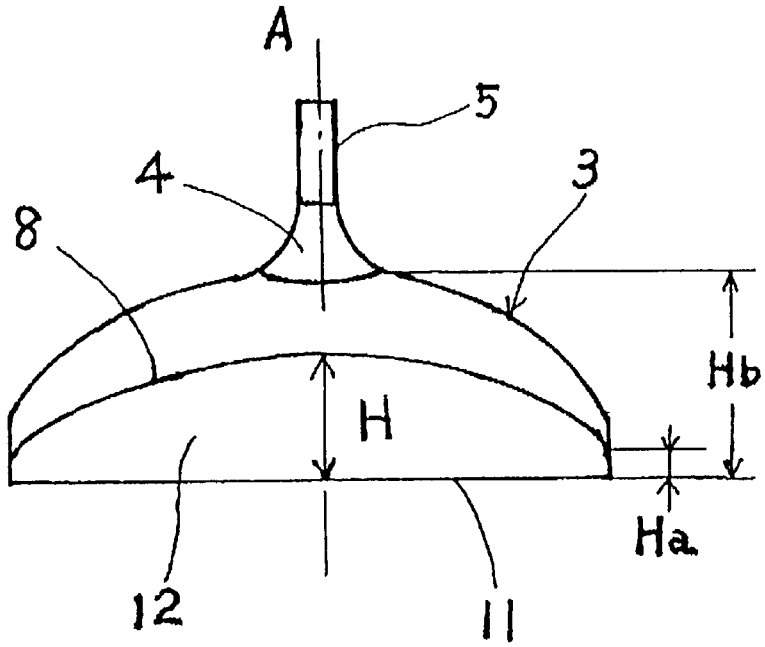
FIG. 3 is a front view of the glass funnel shown in FIG. 1.

As in FIGS. 2 and 3, a body portion 3 does not have a smooth outer surface as in the conventional cathode ray tube, but is provided with arch-like ridge portions 8 at side portions of a rectangular-shaped open end portion of the body portion and arched face portions 12 each being substantially perpendicular to an open end face 11 in the open end portion.

Figure 1:
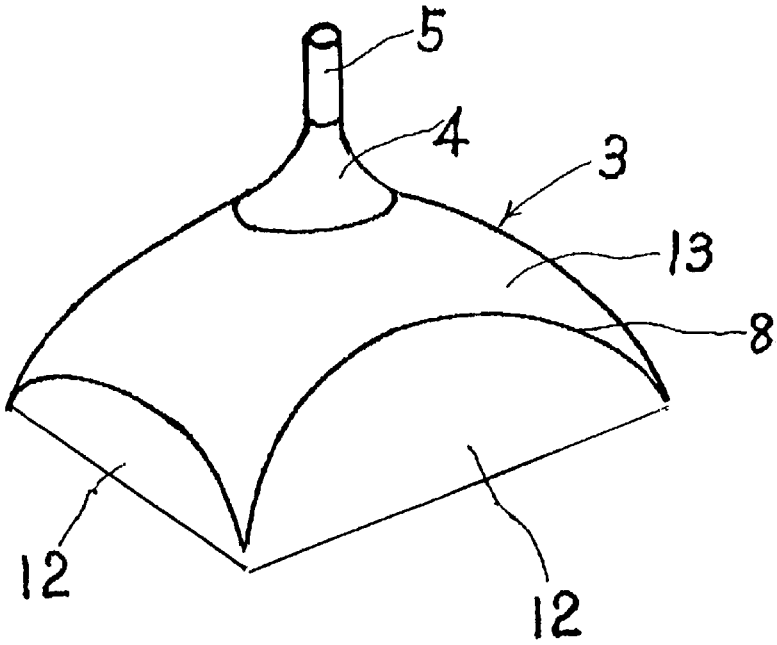
FIG. 1 is a perspective view of the glass funnel according to an embodiment of the present invention.

Both ends of each of the ridge portions 12 are at or near corner portions of the open end portion as shown in FIG. 1. The arched face portions 12 may be perpendicular to the open end face 11. However, a practical way is that they are inclined at an angle of about 5°–15° with respect to a plane which is perpendicular to the open end face 11 and is substantially parallel to each side of the rectangular-shaped open end portion, in consideration of filling molten glass into molds and releasability of a molded product. When a degree of inclination is too much, the effect of the arched face portion for suppressing a deformation of the body portion is reduced. The formation of the arched face portions to be substantially perpendicular to the open end face 11 includes the case that the arched face portions have a certain degree of inclination. Further, the arched face portions 12 may be slightly curved although the drawing shows flat arched face portions.

In order to transmit certainly a force produced in the body portion 3 to the corner portions of high rigidity of the open end portion 7 along the ridge portions 8 as described above, the both ends of each of the ridge portions should be in a predetermined range from the open end face 11. Namely, a range of $Ha \leqq 0.044D+9.6$ is preferred where Ha (mm) represents a distance between an end of a ridge portion 8 and the open end face 11 (FIG. 3) and D (mm) represents the maximum diameter of the open end portion of the glass funnel (FIG. 2). If Ha does not satisfy such range, i.e., the end of the ridge portion is excessively apart from the open end face 11, a force produced at, for example, the middle of a side of the body portion is transmitted to a portion having a low rigidity and there may be produced a high stress there.

In order to obtain a sufficient effect by the ridge portions 8 each having an arch-like shape and to transmit a force produced in, for example, the middle of a long side to corner portions, the ridge portions should have a certain rigidity. Each of the ridge portions has a close relation to the shape of a blend R portion in a ridge portion. In particular, the blend R portion corresponding to the center of a side of the open end portion largely influences. Accordingly, the shape of the blend R portion corresponding to that portion should be specified. Specifically, the radius of curvature of the blend R portion at that portion should be determined as described below.

Description will be made with reference to FIG. 4.

It is preferable that the relation of the radius of curvature R (mm) of the blend R portion of a ridge portion, corresponding to the center of a side of the open end portion, to the maximum diameter D (mm) is $R \leqq 0.07D-9.6$. If R exceeds the value, a predetermined rigidity is not obtainable and the ridge portion can not provide a sufficient effect. The lower limit of R, although there is no restriction, is preferred to be practically 5.0 mm or more, in consideration of a danger of breaking of the ridge portions or moldability of glass.

When the ridge portions 8 are formed in such a manner that the arched face portions 12 are connected to the dome-like portion 13 to have a certain angle, the rigidity of the connecting portions is increased. The present invention utilizes such feature. In order to obtain a sufficient effect, it is preferable that $90° \leqq \theta \leqq 120°$ where θ represents an angle formed by tangential lines at contact points 15 and 14 at which the ridge portions are contiguous to the arched face portions 12 and the dome-like portion 13 (FIG. 4).

When θ exceeds 120°, the angle formed by the tangential lines extended from the arched face portions 12 and the dome-like portion 13 which are contiguous to the ridge portions is too large and a sufficient rigidity can not be expected. On the other hand, when θ is smaller than 90°, it is impossible to remove a molded glass product from the molds. From the viewpoint of moldability and effect by the ridge portions, $100° \leqq \theta \leqq 110°$ is in particular preferable.

The portion between the ridge portions 8 and the yoke portion 4 in the body portion may have a desired shape as far as the above-mentioned condition is satisfied. The glass funnel shown in FIG. 1 has the simplest dome-like shape. The feature of this embodiment resides in that the body portion of the glass funnel other than the arched face portions is in a gently continuous spherical shape. Although it is preferable for the body portion to have such spherical shape because force can be dispersed to the arch-like ridge portions, the present invention is not limited to have a spherical shape. In fact, the shape of this portion is determined depending on requirements in designing the glass funnel as well as the shape of the arched face portion.

Figure 5:
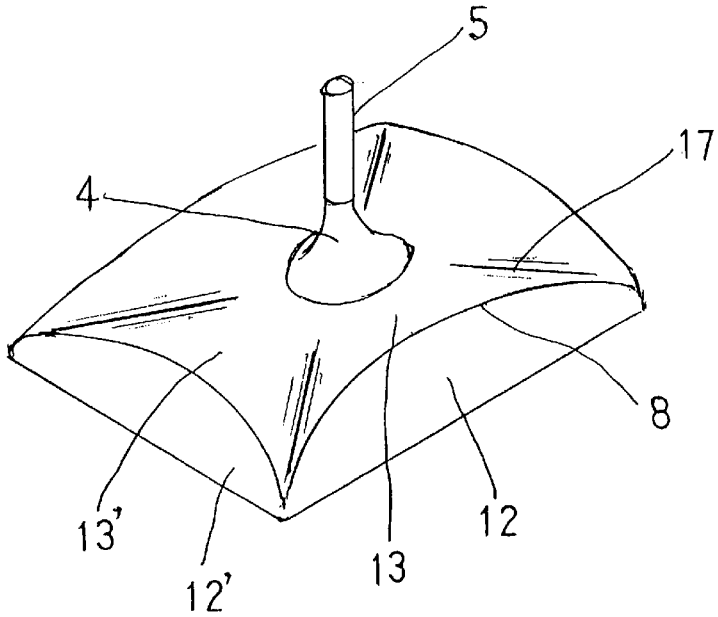
FIG. 5 is a perspective view of the glass funnel according to another embodiment of the present invention.

FIG. 5 shows the glass funnel according to another embodiment of the present invention wherein the body portion has a different shape. In this embodiment, the body portion is flattened in order to reduce the dimension in a tube axis direction of the glass funnel, and at the same time, a structure durable to a stress in vacuum is provided. Specifically, the body portion excluding arched face portions is composed of a convex-like curved face 13 on a long side and a convex-like curved face 13' on a short side. As shown in FIG. 5, ends of curved faces 13, 13' terminate at ridge portions 8 which are contiguous to the arched face portions 12, 12', and the other ends of which are smoothly connected to a yoke portion 4 wherein they are formed integrally, and connecting portions of adjacent curved faces 13, 13' extend along a diagonal line direction of a rectangular-shaped glass funnel. Further, a recess 17 is formed in the diagonally extending connecting portion between the curved faces 13, 13'.

A dome-like portion formed of the curved faces 13, 13' provides a wave-like shape comprising convexes and concaves, which is rather complicate in comparison with the before-mentioned glass funnel of spherical shape. In the present invention, the dome-like portion for forming the body portion includes such wave-like shape. Further, various shapes can be used in the present invention as far as stresses can be dispersed to the arched face portions.

The present invention is also applicable to a glass funnel in which a plurality of yoke portions and neck portions are formed in a single body portion.

Figure 6:
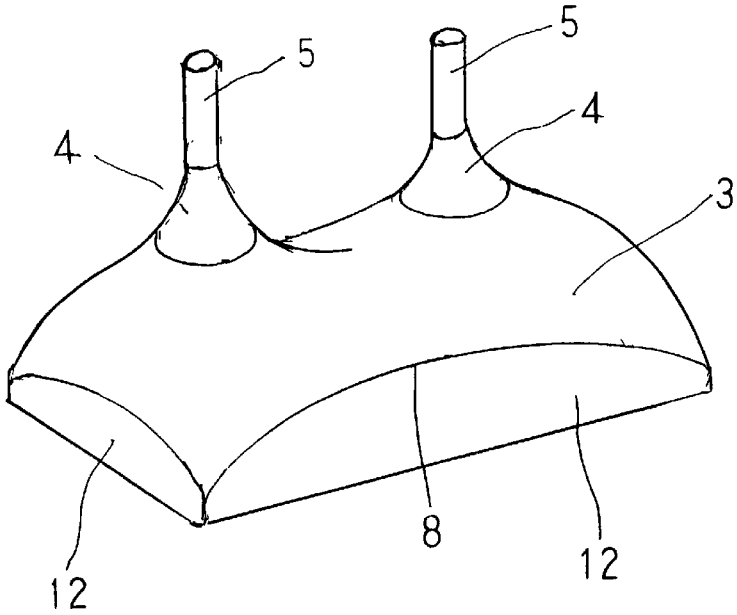
FIG. 6 is a perspective view of the glass funnel according to another embodiment of the present invention.

FIG. 6 shows an embodiment wherein a single body portion 3 is provided with two yoke portions 4 and two neck portions 5. Arched face portions 12 can be formed in this body portion 3 in the same manner as the before-mentioned embodiment. By using such a glass funnel, a single picture image is displayed with two electron guns and two deflection coils, and a surface area to be displayed is shared by a pair of electron guns and deflection coil, namely, a surface area to be shared is half as large as the entire surface area. Accordingly, the dimension in a tube axis direction of the glass funnel can be reduced. In forming two yoke portions 4 and two neck portions 5 in the single body portion 3, a dome-like portion excluding arched face portions 12 may be in a wave-like shape.

In the present invention, it is important for the arched face portions 12 to have a sufficient height in order to obtain an effective function of the arch-like ridge portions. In particular, a careful attention should be paid to the height at the center of the arched face portions since a large stress is produced in vacuum at the center of a long side of the body portion. Since the height of the arched face portions 12 is the dimension from the open end face 11 to a ridge portion 8, the maximum height at the center of the arched face portions is H.

Figure 4:
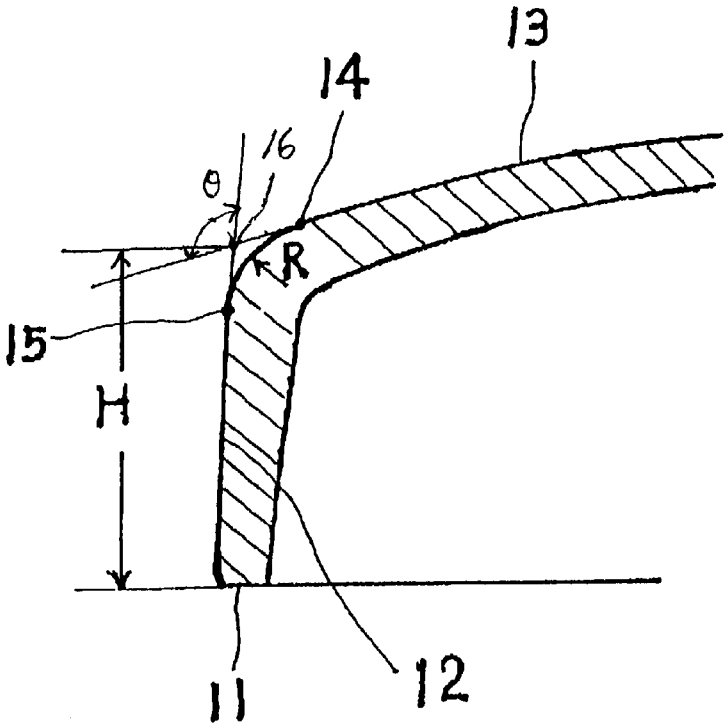
FIG. 4 is a cross-sectional view of a ridge portion taken along a line A—A in FIG. 2.

FIG. 4 is a cross-sectional view taken along the center of the long side of the glass funnel. The maximum height H can be obtained by the following way in FIG. 4. Namely, when the points at which the arched face portions 12 and the dome-like portion 13 are connected to the blend R portion are considered as contact points 14 and 15, and the point at which tangential lines passing these contact points intersect is as a crossing point 16, the maximum height H is obtained as the height from the open end face 11 to the crossing point 16. In order that the arched face portions 12 function effectively to prevent the concentration of stresses to or an increase of stresses in the central portion of the long side of the body portion, it is desirable that H has a predetermined value or more with respect to a value of the body portion 3. When H and a height Hb of the body portion 3 have a relation of $H/Hb \geqq 0.5$, a remarkable effect to prevent the stress concentration is obtainable. In this text, the height Hb of the body portion 3 is a height from the open end face 11 to the top portion of the body portion 3 (a lower end of the yoke portion 4) as shown in FIG. 3.

According to the present invention wherein the arch-like ridge portions are formed in the body portion of the glass funnel, the rigidity of the glass funnel is increased and further, stresses can be reduced because the deformation of the glass funnel can be prevented. As a result, an increase of the stresses can be suppressed even in a case that for example, the body portion is formed into a wide angle type to shorten the depth of it. Further, an increase of weight can be prevented because it is unnecessary to increase the wall thickness in order. to reduce stresses whereby a glass funnel of light weight can be presented.

EXAMPLE

In the following, Examples of the present invention and Comparative Examples are described in Table 1.

Glass panels (hereinbelow, referred to simply as panels) used in these examples were such ones for ordinary cathode ray tube for 34-inch view size television, which had an used screen wherein the aspect ratio was 4:3; the outermost diameter was 859.0 mm; the radius of curvature of the outer surface of the panel was 10000 cm and the diagonal diameter was 81 cm. Each cathode ray tube was prepared by assembling this panel and a glass funnel and stresses produced in the cathode ray tube were measured. The panels and the glass funnels in these examples were of the same glass formulation.

Example 1

The glass funnel of this example was the same as the glass funnel without having ridge portions in the body portion (Comparative Example 1), prepared by the conventional technique, provided that arch-like ridge portions were formed on a long side and a short side of the body portion as shown in FIG. 1.

Example 2

The glass funnel of this example was the same as the glass funnel (Comparative Example 1), prepared by the conventional technique, provided that arch-like ridge portions were formed in the same manner as Example 1 and the dimension in depth was reduced by 90 mm.

Comparative Example 1

Figure 7:
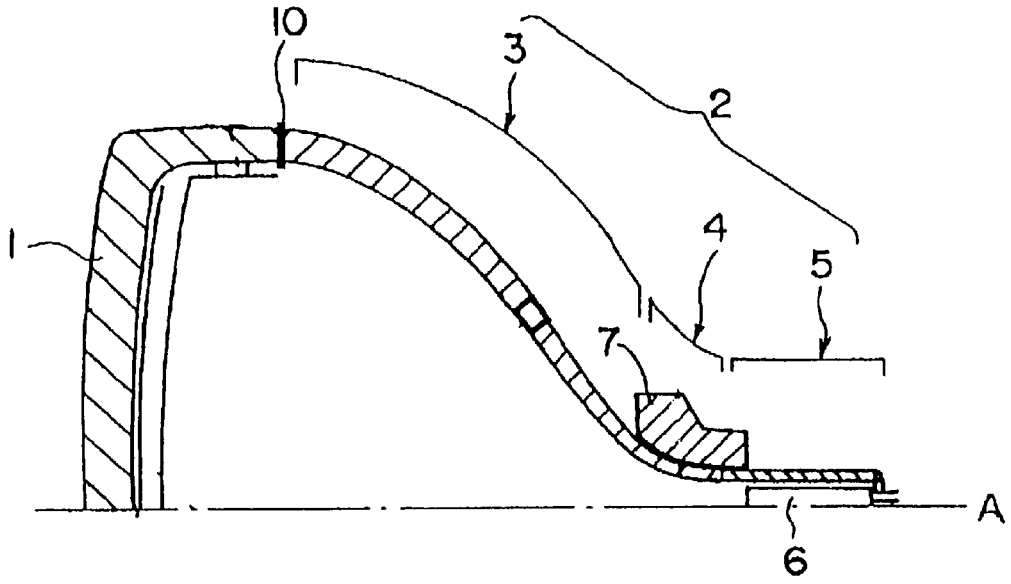
FIG. 7 is a cross-sectional view showing a part of a conventional cathode ray tube.

The glass funnel of this example was such one, by conventional technique, without having ridge portions in the body portion as shown in FIG. 7.

Comparative Example 2

The glass funnel of this example was the same as that of Example 1 provided that the dimension in depth was reduced by 90 mm as in Example 2 and the wall thickness of the glass funnel was adjusted so that stresses produced in the body portion and the sealing portion, when assembled to be a cathode ray tube, were substantially the same as those of Example 2.

As clear in these examples, the stresses produced in the body portion were reduced by forming the ridge portions in the body portion. Namely, Example 1 could maintain substantially the same stresses as in Comparative Example 1 even though the wall thickness of the body portion and the sealing portion were reduced. Further, it was found that when a cathode ray tube was formed by combining the glass funnel with a panel, a stress produced in the panel could be reduced. In the glass funnel of Example 1, the wall thickness of the body portion and the sealing portion were reduced so that stresses to be produced in these portion were the same as those of Comparative Example 1. As a result, the weight of the glass funnel of Example 1 could be reduced by 1.3 kg in comparison with Comparative Example 1.

In Example 2, since the dimension in depth is reduced to form a body portion of wide angle type, stresses fairly increases in this body portion. If the wall thickness of the body portion is increased so as to obtain the same stress as Comparative Example 1, the weight is increased to 2.9 kg as in Comparative Example 2. However, an increase of weight in Example 2 was only 1.0 kg.

TABLE 1

| Items | Ex. 1 | Ex. 2 | Comp. Ex. 1 | Comp. Ex. 2 |
|---|---|---|---|---|
| Distance from open end portion to front end (Hb) of yoke portion (mm) | 185.0 | 95.0 | 185.0 | 95.0 |
| Length of yoke portion (mm) | 65.0 | 65.0 | 65.0 | 65.0 |
| Total length of glass funnel (mm) | 387.5 | 297.5 | 387.5 | 297.5 |
| Maximum outer diameter of open end portion (mm) | 852.0 | 852.0 | 852.0 | 852.0 |
| Wall thickness of body portion (mm) | 6.0 | 10.5 | 7.0 | 18.0 |
| Wall thickness of sealing portion (mm) | 9.5 | 16.0 | 13.0 | 20.0 |
| Weight of glass funnel (kg) | 12.1 | 14.4 | 13.4 | 16.3 |
| Maximum stress produced in sealing portion (Mpa) | 7.0 | 6.8 | 7.0 | 7.0 |
| Maximum stress produced in body portion (MPa) | 10.0 | 9.5 | 9.0 | 9.3 |
| Radius of curvature R of ridge portion (mm) | 45.0 | 20.0 | — | — |
| Distance (Ha) between end of ridge portion and open end face (mm) | 16.0 | 16.0 | — | — |
| Angle θ between arched face and dome-like portion (°) | 110 | 110 | — | — |
| H/Hb | 0.65 | 0.80 | — | — |

(Remark) Wall thickness of body portion: 90 mm from open end face on short axis

According to the glass funnel of the present invention wherein ridge portions are formed in the body portion, the rigidity of the body portion as the major component of a vacuumed envelop can be increased and stresses which may produce in the body portion can be suppressed as a result of which reduction in the weight can easily be achieved. Further, in addition to this, reduction in the dimension in depth of the glass funnel can also be achieved while the weight in practical use is maintained. Thus, a safe, highly reliable cathode ray tube can be provided.

Namely, the presence of the ridge portions in the body portion suppresses a spread of deformation to long and short sides of an open end portion of the body portion, with the result that stresses in the sealing portion can remarkably be reduced. Accordingly, the wall thickness of not only the sealing portion but also the body portion can be reduced, whereby a substantial reduction of weight can be realized.

The conventional funnel glass had such a structure that a deformation caused in the body portion was transmitted to the glass panel through the sealing portion. Accordingly, a stress in the glass panel was also increased. However, according to the present invention; a stress can be transmitted to corner portions of high rigidity of the open end portion, whereby the stress in the glass panel can be reduced and the weight of the glass panel is reduced.

In the cathode ray tube of the present invention in which the weight is reduced by reducing the wall thickness, the production of a thermal stress in a thermal processing during the manufacture of the cathode ray tube is also reduced and productivity can be improved.

Further, in the present invention, both ends of the arch-like ridge portions are at or near corner portions of high rigidity of the open end portion, and the positions of the both ends of the ridge portions, i.e., the height of the both ends of the ridge portions from the open end face at the corner portions of the open end portion is specified. Accordingly, the spread of a stress in a portion of the body portion to another portion can be suppressed.

What is claimed is:

1. A glass funnel for a cathode ray tube comprising:

a funnel-like body portion having a rectangular-shaped open end portion at its one end;

a yoke portion formed contiguous to the other end of the body portion; and a neck portion connected hermetically to the free end of the yoke portion, wherein the body portion has, on at least its long side, substantially flat arched face portions each of which is substantially perpendicular to an open end face in the rectangular-shaped open end portion and has an arch-like ridge portion whose both ends are extended to portions in the vicinity of corner portions of the open end portion, and the body portion is formed with the arched face portions and a dome-like portion each arch-like ridge portion having a blend R portion for transitioning an arched face portion to the dome like portion, and the relation of the radius of curvature R (mm) of the blend R portion to the maximum diameter D (mm) of the open end portion is $R \leqq 0.07D-9.6$.

2. The glass funnel for a cathode ray tube according to claim 1, wherein the arched face portions are provided on a short side in addition to the long side.

3. The glass funnel for a cathode ray tube according to claim 1, wherein the angle 8 formed between a tangential line passing a connecting point which connects the blend R portion to the arched face portion and a tangential line passing the connecting point which connects the blend R portion to the dome-like portion in the middle of the ridge portion in a side of the rectangular-shaped open end portion, is in a range of $90° < \theta < 120°$.

4. The glass funnel for a cathode ray tube according to claim 1, wherein in the portions in the vicinity of the corner portions of the open end portion, the relation of the height Ha (mm) of both ends of each of the arch-like ridge portions from the open end face to the maximum diameter D (mm) of the open end portion is $Ha \leqq 0.044D+9.6$.

5. The glass funnel for a cathode ray tube according to claim 1, wherein the relation of the maximum height H of the arch-like ridge portion from the open end face to the height Hb of the body portion is $H/Hb \geqq 0.5$.

6. The glass funnel for a cathode ray tube according to claim 1, wherein the dome-like portion of the body portion has a recessed portion in the direction of a diagonal line of the body portion.

7. The glass funnel for a cathode ray tube according to claim 1, wherein the body portion is provided with a plurality of yoke portions and neck portions.

8. A cathode ray tube using the glass funnel for a cathode ray tube described in claim 1.

* * * * *